US007003956B2

(12) United States Patent
Yamashita et al.

(10) Patent No.: US 7,003,956 B2
(45) Date of Patent: Feb. 28, 2006

(54) STEAM TURBINE, STEAM TURBINE PLANT AND METHOD OF OPERATING A STEAM TURBINE IN A STEAM TURBINE PLANT

(75) Inventors: Katsuya Yamashita, Tokyo (JP); Kohei Nagane, Kanagawa-ken (JP); Yukio Shinozaki, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/835,593

(22) Filed: Apr. 30, 2004

(65) Prior Publication Data

US 2004/0261417 A1 Dec. 30, 2004

(30) Foreign Application Priority Data

Apr. 30, 2003 (JP) ..... 2003-125672

(51) Int. Cl.
*F01K 13/02* (2006.01)

(52) U.S. Cl. ..... 60/646; 60/657; 415/115

(58) Field of Classification Search ..... 60/646, 60/657; 415/115, 116
See application file for complete search history.

(56) References Cited

U.S. PATENT DOCUMENTS

| | | | | |
|---|---|---|---|---|
| 3,817,654 | A * | 6/1974 | Sohma | 415/103 |
| 4,550,569 | A * | 11/1985 | Isa et al. | 60/657 |
| 5,906,095 | A * | 5/1999 | Frutschi et al. | 60/775 |
| 6,102,654 | A | 8/2000 | Oeyhausen et al. | |
| 6,237,338 | B1 | 5/2001 | Magoshi et al. | |
| 6,272,841 | B1 * | 8/2001 | Yamamoto et al. | 60/39.182 |
| 6,502,403 | B1 * | 1/2003 | Tazaki et al. | 60/784 |
| 6,578,352 | B1 * | 6/2003 | Morikawa et al. | 60/39.182 |

FOREIGN PATENT DOCUMENTS

| | | | |
|---|---|---|---|
| DE | 3042782 | A1 | 6/1982 |
| EP | 1050666 | A2 | 11/2000 |
| JP | 58-113501 | A | 7/1983 |
| JP | 8-338205 | A | 12/1996 |
| JP | 9-177505 | A | 7/1997 |
| JP | 9-317405 | A | 12/1997 |
| JP | 11-350911 | A | 12/1999 |

OTHER PUBLICATIONS

U.S. Appl. No. 10/849,552, filed May 20, 2004, Nagane et al.

* cited by examiner

*Primary Examiner*—Hoang Nguyen
(74) *Attorney, Agent, or Firm*—Foley & Lardner LLP

(57) ABSTRACT

A steam turbine and steam turbine plant that can utilize a relatively higher reheated steam, such as about 1300 degrees Fahrenheit or higher, is provided. A steam turbine plant includes a steam generator generating high pressure steam and reheated steam, a high pressure turbine driven by the high pressure steam generated by the steam generator, and an intermediate pressure turbine driven by the reheated steam. A steam bleed line coupled with the high pressure turbine bleeds steam from the high pressure turbine as cooling steam. The intermediate pressure turbine includes a heated steam inlet for receiving the reheated steam, and a cooling steam inlet for receiving the cooling steam. The cooling steam cools components of the intermediate pressure turbine that receive the reheated steam. A low pressure turbine is driven by steam discharged from the intermediate pressure turbine, and a condenser condenses steam discharged from the low pressure turbine into water as a condensate. A plurality of feedwater heaters heat the condensate to produce feedwater provided to the steam generator.

22 Claims, 4 Drawing Sheets

STEAM TURBINE, STEAM TURBINE PLANT AND METHOD OF OPERATING A STEAM TURBINE IN A STEAM TURBINE PLANT

CROSS REFERENCE TO RELATED APPLICATION

This application is based upon and claims the benefit of priority from the prior Japanese Patent Application No. 2003-125672 filed on Apr. 30, 2003, the entire contents of which are incorporated herein by reference.

1. Field of the Invention

This invention relates to a steam turbine, a steam turbine plant and a method of operating a steam turbine, and in particular a turbine, turbine plant and method that permits operation with an increased steam temperature.

2. Description of the Background

Recently, for steam turbine plants, increasing the temperature of steam has been discussed to improve the thermal efficiencies of plants.

Conventional steam turbine plants generally introduce a one-stage reheating configuration using reheated steam. In the steam turbine plant with the one-stage reheating configuration, steam at a temperature of about 1000 degrees Fahrenheit is used for a high pressure turbine, while steam at a temperature of 1000 or 1050 degrees Fahrenheit is used for an intermediate pressure turbine as reheated steam.

According to the Rankine cycle, which is a thermal cycle generally used in a steam turbine plant, when the steam temperature is increased, the plant thermal efficiency can be more improved.

A conventional high pressure turbine and intermediate pressure turbine for a steam turbine plant is described in Japanese Patent Application (Kokai) No. 11-350911. In this publication, the intermediate pressure turbine uses steam at a temperature about 1100 degrees Fahrenheit as reheated steam, the turbine having a reheated steam supply tube with a steam-cooled double-tubing structure.

However, such a system cannot effectively operate with a temperature of the reheated steam above about 1300 degrees Fahrenheit (or about 700 degrees Celsius), and there remain problems to be solved. With such temperature, the constituent components exposed to such high temperature may cause steam oxidation, which may weaken the strength of those turbine constituent components. This reduces the life of the components and can eventually lead to the turbine breaking down. In short, such conventional system do not effectively operate at the higher temperatures, such as 1300 degrees Fahrenheit and above.

SUMMARY OF THE INVENTION

Accordingly, an advantage of an aspect of the present invention is to provide a steam turbine, steam turbine plant and method of operating a steam turbine in a steam turbine plant that improves the plant thermal efficiency by increasing the temperature of the reheated steam to a high temperature, while maintaining the strength of turbine constituent components despite the high steam temperature of the reheated steam.

To achieve the above advantage, one aspect of the present invention is to provide a steam turbine plant that may comprise a steam generator that produces high pressure steam and reheated steam, a high pressure turbine coupled with the steam generator and driven by the high pressure steam generated in the steam generator, a steam bleed line coupled to the high pressure turbine, the steam bleed line bleeds steam from the high pressure turbine as cooling steam, an intermediate pressure turbine coupled with the steam generator and driven by the reheated steam, the intermediate pressure turbine comprising a heated steam inlet for receiving the reheated steam, and a cooling steam inlet coupled with the steam bleed line to receive the cooling steam, the cooling steam being lower in temperature than the reheated steam at the reheated steam inlet, a low pressure turbine driven by steam discharged from the intermediate pressure turbine, a condenser that condenses the steam discharged from the low pressure turbine into a condensate, and a plurality of feedwater heaters which heat the condensate to form feedwater that is provided to the steam generator.

Further, another aspect of the present invention is to provide a steam turbine that may comprise a casing, a rotor rotatably installed in the casing, a plurality of turbine stages disposed in the turbine, at least one of the turbine stages including a turbine nozzle and a moving blade being fixed to the rotor, a steam pass including the at least one turbine stage, a heated steam inlet that is coupled with the steam pass, for providing a heated steam into the turbine, and a cooling steam inlet that introduces cooling steam to a space between the rotor and the casing.

Further, another aspect of the present invention is to provide a method of operating a steam turbine in a steam turbine plant that may comprise the steps of introducing a heated steam into the turbine through the heated steam inlet, passing the heated steam trough the plurality of the turbine stages, introducing cooling steam into the turbine through the auxiliary inlet, and passing the cooling steam through at least one of the plurality of turbine stages to cool at least a portion of the at least one turbine stages, wherein the cooling steam is significantly cooler than the heated steam as introduced through the heated steam inlet.

Further features, aspects and advantages of the present invention will become apparent from the detailed description of preferred embodiments that follows, when considered together with the accompanying figures.

DETAILED DESCRIPTION OF THE PREFERRED EMBODIMENTS

Figure 1:
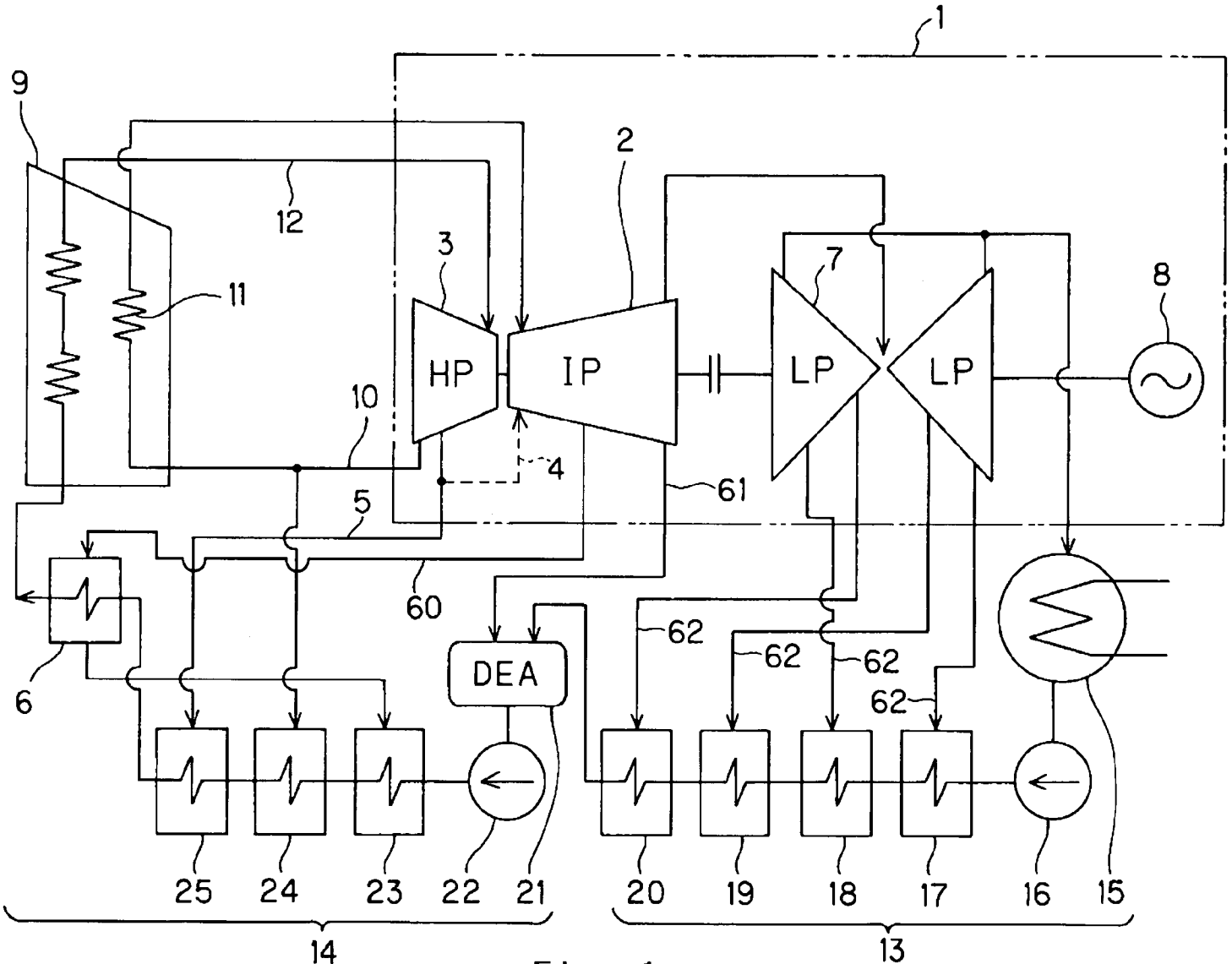
FIG. 1 is a schematic diagram showing an embodiment of a steam turbine plant according to the present invention.

An embodiment in accordance with the present invention will be explained with reference to FIGS. 1 to 4. FIG. 1 is a schematic diagram showing an embodiment of a steam turbine plant according to the present invention.

A steam turbine plant includes a steam turbine 1, a boiler 9 as a steam generator, a condensate system 13 and a feedwater system 14.

Steam turbine 1 includes an intermediate pressure turbine 2, a high pressure turbine 3, a low pressure turbine 7 having a double-flow type configuration and a generator 8. Rotating shafts of those intermediate pressure turbine 2, high pressure turbine 3, low pressure turbine 7 and generator 8 are connected each other, steam turbine 1 has a one rotating shaft as a whole.

Boiler 9, as a steam generator, produces high pressure main steam, which is supplied to high pressure turbine 3 through line 12. The main steam expands while it flows through the high pressure turbine 3, performing expansion work that drives high pressure turbine 3. A high pressure steam bleed line 5 is communicatively connected to high pressure turbine 3 at an intermediate stage of high pressure turbine 3, and bleeds steam from high pressure turbine 3.

The main steam expanded in high pressure turbine 3 is discharged from high pressure turbine 3 to a low temperature reheat line 10 as high pressure turbine discharged steam. The high pressure turbine discharged steam is supplied to boiler 9, reheated by a reheater 11 to produce reheated steam (another form of heated steam) having a temperature, for example, of about 1300 or more degrees Fahrenheit. The reheated steam is supplied to intermediate pressure turbine 2 so as to do expansion work and drive intermediate pressure turbine 2. A cooling steam supply line 4 is communicatively connected to intermediate pressure turbine 2 at a point relatively upstream of the intermediate pressure turbine 2. Cooling steam supply line 4 introduces part of the steam bled from the high pressure turbine 3 via high pressure steam bleed line 5 as a cooling steam in intermediate pressure turbine 2. Intermediate pressure steam bleed lines 60 and 61, which bleed steam from intermediate stages of intermediate pressure turbine 2, are connected to intermediate pressure turbine 2.

The reheated steam, as expanded in intermediate pressure turbine 2, is discharged from intermediate pressure turbine 2. This discharged steam is supplied to low pressure turbine 7, where it further expands to drive low pressure turbine 7. In this manner, high pressure turbine 3, intermediate pressure turbine 2, low pressure turbine 7 and generator 8 are all driven by steam. Low pressure steam bleed lines 62, which bleed steam from intermediate stages of low pressure turbine 7, are connected to low pressure turbine 7.

Condensate system 13 includes a condenser 15, a condensate pump 16, a first low pressure feedwater heater 17, a second low pressure feedwater heater 18, a third low pressure feedwater heater 19, and a fourth low pressure feedwater heater 20. Steam discharged from low pressure turbine 7 is introduced and condensed into condensate in condenser 15. The condensate is pumped by condensate pump 16 and flows through the low pressure feedwater heaters 17–20 in order, being heated with steam bled supplied from each of low pressure steam bleed lines 62 that are connected to low pressure turbine 7.

Feedwater system 14 includes a deaerator 21, a feedwater pump 22, a first high pressure feedwater heater 23, a second high pressure feedwater heater 24, a third high pressure feedwater heater 25 and a desuperheater 6 along the stream of the feedwater, downstream from the high pressure feedwater heaters 23–25. The condensate supplied from fourth low pressure feedwater heater 20 of the condensate system 13 is heated and deaerated using deaerator 21, where the heating source is steam bled from the intermediate pressure steam bleed line 61 on a relatively downstream part of intermediate pressure turbine 2. Feedwater is formed in this manner. Desuperheater 6 is arranged at the most downstream side of feedwater system 14. Desuperheater 6 heats feedwater heater using the sensible heat of steam bled in the intermediate pressure steam bleed line 60 connected to a relatively upstream part of intermediate pressure turbine 2. Such steam has a relatively high degree of superheat, as preferable for further heating the feedwater from the third high pressure feedwater heater 25 in feedwater system 14.

The feedwater is pumped by the feedwater pump 22. The water is heated by the first through third high pressure feedwater heaters 23, 24, and 25, in their respective order. The feedwater from third high pressure feedwater heater 25 is supplied to desuperheater 6, where it is further heated. First high pressure feedwater heater 23 uses steam flowing from desuperheater 6 as a heating source, which has taken the sensible heat from the steam in the intermediate pressure steam bleed line 60 and has been reduced to close to a saturation temperature in desuperheater 6. Second high pressure feedwater heater 24 uses discharged steam from high pressure turbine 3, through line 10, as a heating source. Third high pressure feedwater heater 25 uses steam bled from high pressure steam bleed line 5 connected to an intermediate stage of high pressure turbine 3. With this arrangement, the feedwater flowing through first high pressure feedwater heater 23 to desuperheater 6 is heated and returned as heated feedwater into the boiler 9.

As previously noted, cooling steam is introduced into intermediate pressure turbine 2 from cooling steam supply line 4. The cooling steam flows inside intermediate pressure turbine 2 and cools constituent components such as turbine rotor, nozzle box, casings, gland sealing of the turbine or steam supply line, etc. as discussed in more detail below.

In this embodiment, it is contemplated to supply steam having a temperature about 1300 degrees Fahrenheit (or more) to intermediate pressure turbine 2, where it expanded. This is because intermediate pressure turbine may have more capacity, such the number of turbine stages, than high pressure turbine 3. Intermediate pressure turbine 2 may produce more work than high pressure turbine 3 when supplied with high temperature steam. This results in the steam turbine plant may achieve high thermal efficiency.

As described above, the steam turbine plant according the embodiment of the present invention has steam cooling line 4 that supplies high pressure cooling steam, bled from high pressure turbine 3 through line 5, to intermediate pressure turbine 2. Since the cooling steam from steam cooling line 4 is introduced to intermediate pressure turbine 2 and cools constituent components of intermediate pressure turbine 2, it can effectively maintain the strength of the constituent components even in the situation of using high temperature steam, such as about 1300 degrees Fahrenheit, with intermediate pressure turbine 2.

Further, the steam turbine plant preferably has desuperheater 6 in feedwater system 14. Desuperheater 6 heats the feedwater using sensible heat of steam bled from the intermediate pressure steam bleed line that supplies steam that is superheated. Since desuperheater 6 is separately arranged at a downstream side of feedwater system 14, it may further improve thermal efficiency of the steam turbine plant.

Figure 2:
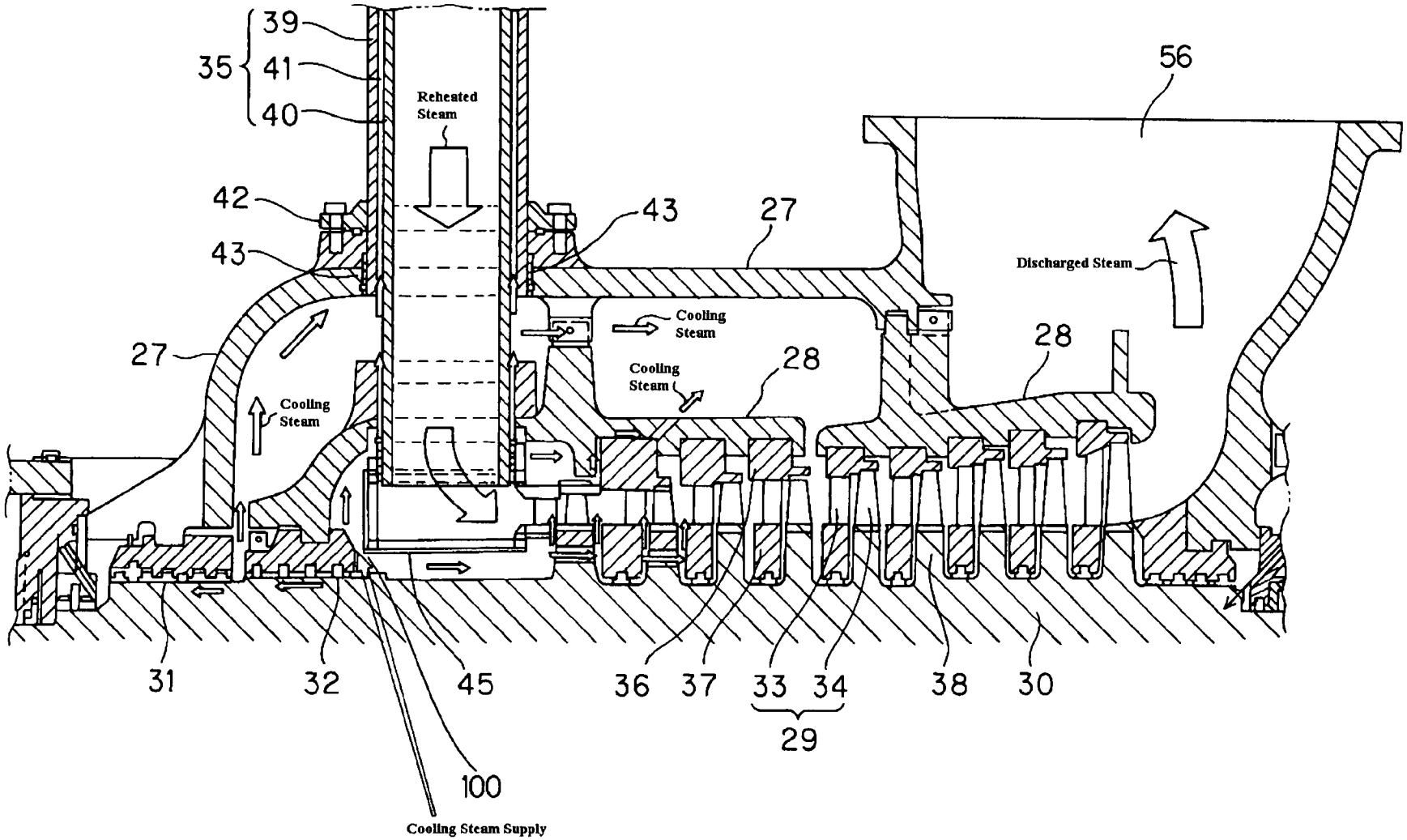
FIG. 2 is a vertical cross section view showing an embodiment of a steam turbine as an intermediate pressure turbine according to the invention.

FIG. 2 is a vertical cross section view showing in greater detail the intermediate pressure turbine 2 of the present embodiment. As noted, the reheated steam is supplied from reheater 11 of boiler 9, and in this embodiment, it is contemplated to use reheated steam having a temperature of about 1300 degrees Fahrenheit.

Intermediate pressure turbine 2 has an axial flow type configuration with a double casing structure including an outer casing 27 and an inner casing 28. A turbine rotor 30 is rotatably installed in inner casing 28. Turbine stages 29 are accommodated between turbine rotor 30 and inner casing 28.

Turbine rotor 30 has its both ends supported by bearings (not shown). The intermediate pressure turbine has, upstream of the reheated steam, a gland portion 31 for outer casing 27 mounted between turbine rotor 30 and outer casing 27, and a gland portion 32 for inner casing 28 are mounted between turbine rotor 30 and inner casing 28. The gland portion provide rotatable couplings between the turbine rotor 30 and outer and inner casings 27, 28. A plurality of turbine stages 29, each having a combination of a turbine nozzle 33 and a turbine moving blades 34, are mounted from the first stage of the turbine adjacent the side of reheated steam tube 35 to the final stage of turbine adjacent the side of turbine exhaust chamber 56. Turbine stages 29 as a whole constitute a path for the reheated steam as a "steam pass".

Both radial ends of turbine nozzle 33 are supported by an outer diaphragm ring 36 and an inner diaphragm ring 37. Outer diaphragm ring 36 is positioned on and fixed to inner casing 28. Turbine moving blades 34 are implanted on a turbine disk 38 integrally formed with the turbine rotor 30 (such as by machining the rotor). Turbine moving blades 34 are arranged circumferentially of turbine rotor 30, and positioned adjacent to respective turbine nozzles 33 along an axial direction of turbine rotor 30.

Intermediate pressure turbine 2 has reheated steam tube 35, which supplies the reheated steam from the reheater 11 of the boiler 9 to turbine nozzle 33 in the first stage of turbine via nozzle box (steam chamber) 45 (or other form of a heated steam inlet). Cooling steam is supplied to the intermediate pressure turbine through an inlet 100.

Figure 3:
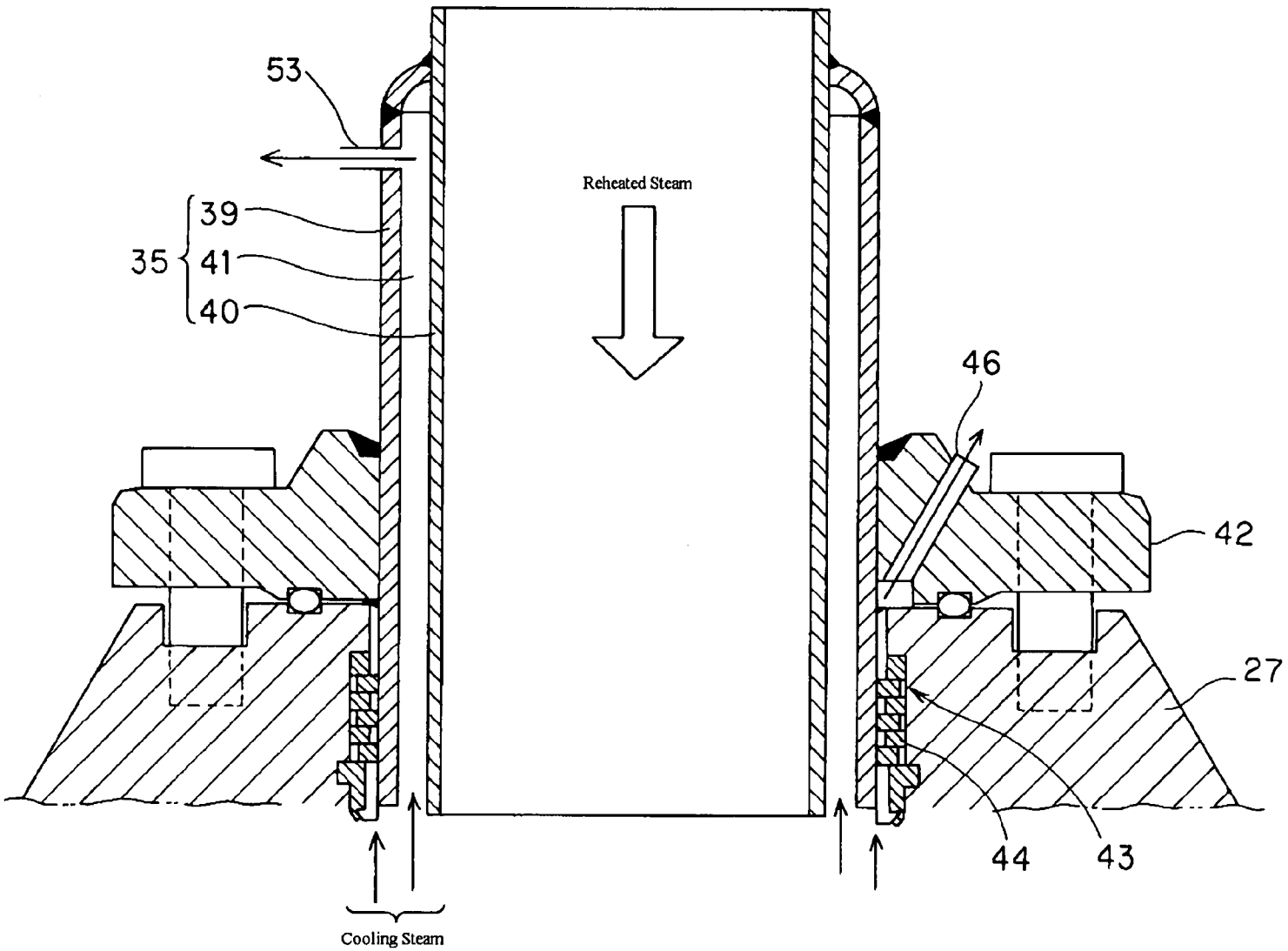
FIG. 3 is a cross section view showing an embodiment of the reheated steam tube as a steam supply tube for the steam turbine according to the invention.

FIG. 3 shows, in a cross section view, a more detailed depiction of the reheated steam tube 35 as a steam supply tube of the intermediate pressure turbine 2 according to the embodiment of the invention.

As shown in FIG. 3, reheated steam tube 35 preferably has a double tube structure including an outer tube 39 and an inner tube 40 disposed coaxially and spaced from the outer tube 39. A cooling steam passage 41 is formed in the coaxial space between outer tube 39 and inner tube 40, leading to an outlet 53. A sealing device 43 for the outer casing 27 is mounted between outer tube 39 and a flange 42 of outer casing 27.

The sealing device 43 includes a plurality of rings 44, alternate adjacent rings 44 having varying diameters, as shown in FIG. 3. The ring 44 are mounted between the outer tube 39, along its axis, and outer casing 27. The cooling steam leaking from the rings 44 is recovered by a heat exchanger, for example, via outflow port 46.

Figure 4:
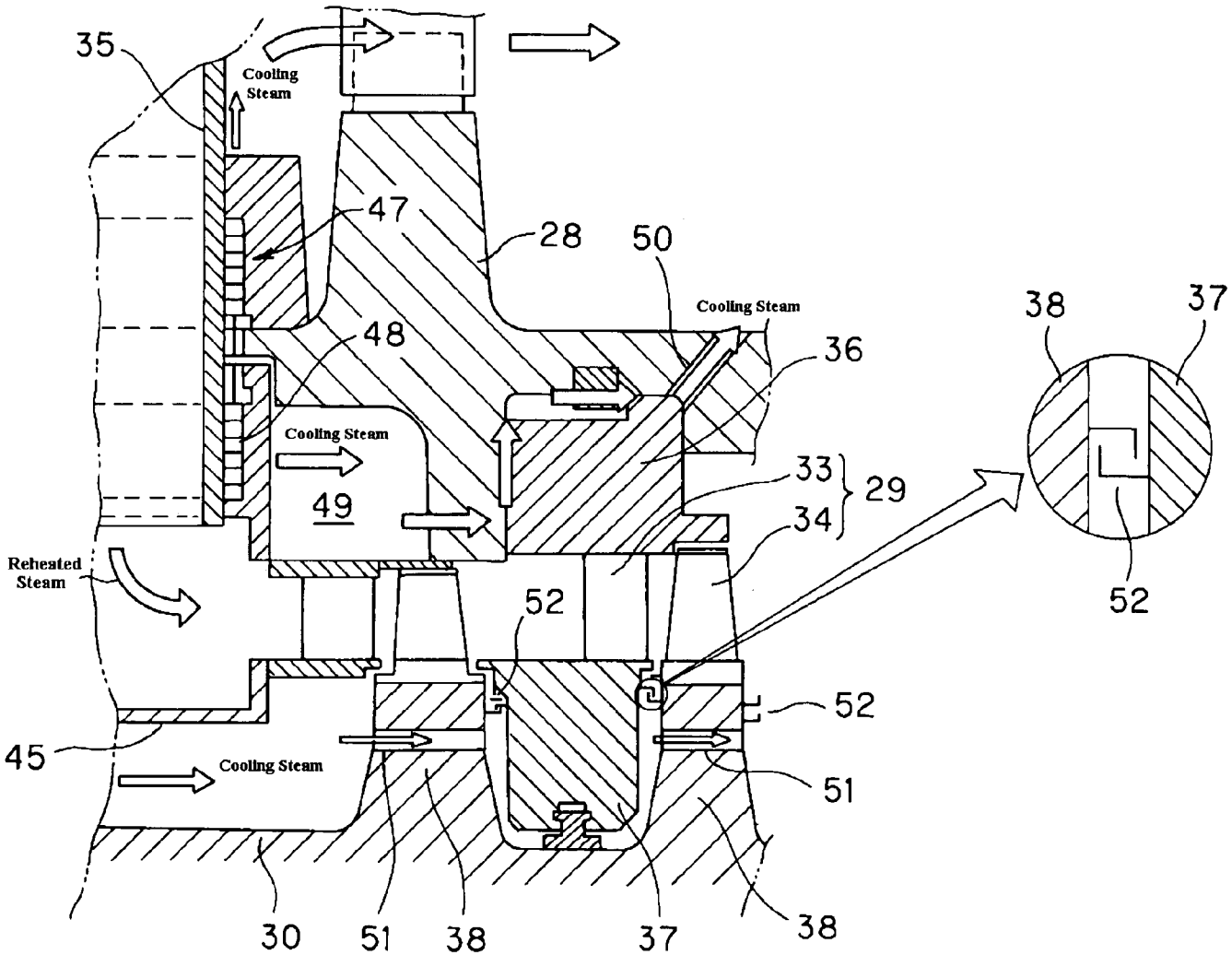
FIG. 4 is a cross section view showing an embodiment of the first and second turbine stages of the steam turbine according to the invention.

FIG. 4 is a cross section view showing in more detail the first and second stage of the steam turbine according to an embodiment of the invention.

As shown in FIG. 4, a sealing device 47 is positioned between the reheated steam tube 35 and inner casing 28. Sealing device 47 is mounted in an insertion portion of the inner casing 28. An end of reheated steam tube 35 is disposed in nozzle box 45 as an unrestricted free end, which accounts for the tube axial expanding, thereby elongating due to heat of the reheated steam.

Sealing device 47 for inner casing 28 has a plurality of layers of rings 48 mounted along and relative the axis of reheated steam tube 35. These rings 48 cause the cooling steam leaking therefrom to flow out to the wake side of the turbine stages 29, i.e., toward the outer casing and along the reheated steam tube 35.

A space chamber 49 is formed between the inner casing 28 and the first stage of the turbine. The cooling steam guided into space chamber 49, via rings 48, passes across the surface of the side and head of outer diaphragm ring 36 of the second stage of turbine. Then, the cooling steam flows out radially (e.g., at an angle) toward the outer casing 27 from an outlet 50. An alternative is to provide a further path adjacent the third (and/or subsequent) turbine stage 29 for the cooling steam before flowing radially out into the area between the inner and outer casings 28,27. The number of turbine stages 29 through which the cooling steam passes may be determined and set according to experiment to determine at what point the reheated steam temperature drops to desired amount when flowing through the turbine.

Turbine disk 38, integrally formed (such as by machining) with the turbine rotor 30, has balance wheels 51 in the first stage of turbine and the second stage of turbine, respectively. The cooling steam that has cooled nozzle box 45 is supplied to successive stages of the turbine via balance wheels 51 associated with turbine disks. A seal 52, which may be hook-shaped for example, is mounted between the front stage of turbine and the rear stage of turbine to prevent the cooling steam from leaking into the steam pass, which is the path of the reheated steam.

A method of operating a steam turbine in a steam turbine plant according using the above-described embodiment of turbine and turbine plant is explained below.

To further improve the plant thermal efficiency, the reheated steam of high temperature, such as about 1300 degrees Fahrenheit or more, is supplied to intermediate pressure turbine 2 of steam turbine 1.

As shown in FIG. 1, the steam from high pressure turbine 3 bled from the intermediate stage of the high pressure turbine 3 is supplied as cooling steam to the high temperature components of intermediate pressure turbine 2 via cooling steam supply line 4 that branches off from high pressure steam bleed line 5. The cooling steam is introduced inside a space between turbine rotor 30 and inner casing 28 from cooling steam inlet 100 disposed near gland portion 32. Part of the cooling steam introduced from cooling steam inlet 100 passes through gland portion 32 for inner casing 28 and is supplied to a space between inner casing 28 and outer casing 27. A pressure of cooling steam may drop to some extent when it passes through gland portion 32.

As shown in FIG. 2, the cooling steam supplied to the space between turbine rotor 30 and inner casing 28 cools constituent components such as an outer surface of nozzle box 45, reheated steam supply tube 35, inner casing 28, turbine disk 38, outer diaphragm ring 36 which supports turbine nozzle 33, and inner diaphragm ring 37. The cooling steam supplied to the space between inner casing 28 and outer casing 27 cools constituent components such as gland portion 32 for inner casing 28, gland portion 31 for outer casing 27, reheated steam supply tube 35, inner casing 28, and outer casing 27. In this manner, constituent components of intermediate pressure turbine 2 are cooled and the strength of those constituent components is maintained, despite the high temperature steam in the reheated supply tube 35.

Since the cooling steam is bled from the intermediate stage of high pressure turbine 3, a temperature of the cooling steam may be about 930 or less degrees Fahrenheit. Meanwhile a temperature of the reheated steam supplied to intermediate pressure turbine 2 may be about 1300 or more degrees Fahrenheit. The cooling steam will be significantly lower in temperature than the reheated steam, such as at least 200 degrees Fahrenheit. Further, as to a pressure, the cooling steam bled from the intermediate stage of high pressure turbine 3 may be about 80 atmospheres, which is several tens atmospheres higher than a pressure of reheated steam supplied to intermediate pressure turbine 2. Thus, the cooling steam supplied to intermediate pressure turbine 2 via cooling steam supply line 4 can cool constituent components of intermediate pressure turbine, and maintain the strength of such components.

The cooling steam that has cooled the outer surface of the nozzle box 45 is supplied to the reheated steam tube 35 in which the inner casing 28 and the outer casing 27 are inserted, inner casing 28, outer casing 27, turbine disk 38, gland portion 32 for inner casing 28, and gland portion 31 for outer casing 28, thus cooling the constituent components of high temperature.

As shown in FIG. 4, the cooling steam supplied to the reheated steam tube 35, in which the inner casing 28 is inserted, is partly passed through rings 48 of sealing device 47, which sealing device is mounted between reheated steam tube 35 and inner casing 28 to cool reheated steam tube 35. The cooling steam is also supplied into space chamber 49 formed between the first stage of turbine and inner casing 28. The cooling steam flows from chamber 49 into a gap between outer diaphragm ring 36 and inner casing 28, cooling outer diaphragm ring 36 and inner casing 28. The cooling steam passes over the side and head surface of the outer diaphragm ring 36 (of the second stage of the turbine) and out towards the outer casing 27 through outlet port 50. This cools the inner diameter sides of the diaphragm outer ring 36 and inner casing 28.

In this embodiment, a temperature of reheated steam expanded in the turbine pass will reduce to about 1050 or less degrees Fahrenheit, which is almost the same temperature as reheated steam supplied to conventional intermediate pressure turbine, at approximately the second stage of turbine. For this reason, outlet port 50 is preferably disposed at the second stage of turbine in inner casing 28 in this embodiment. In other words, a path of the cooling steam is preferably designed to cool the constituent components that are exposed to the high temperature of the reheated steam.

The cooling steam that has cooled the outer surface of the nozzle box 45 is drawn into balance wheels 51 in turbine disks 38 formed in the first and second stages of turbine, respectively, by a pumping force that is produced when turbine disks 38 rotates.

The cooling steam drawn in by the pumping force leaves the balance wheels 51 and cools turbine disks 38 that are subject to exposure to the high temperature reheated steam. The seal 52 blocks off the cooling steam flowing directly toward the radial direction (outward), and into the steam pass.

Further, as shown in FIG. 3, cooling steam is supplied into the cooling steam passage 41, after it has cooled reheated steam tube 35, gland portion 32 for inner casing 28, and, through one of the paths, gland portion 31 for outer casing 27. As shown in FIG. 3, steam passage 41 is formed between outer tube 39 and inner tube 40 of reheated steam tube 35. Sealing device 43 being mounted on the outer tube 39 of the reheated steam tube 35 in which the outer casing 27 is inserted.

The cooling steam that has been supplied to sealing device 43 for the outer casing cools the outer tube 39 of the reheated steam tube 35. Part of the cooling steam leaking from the sealing device 43 for the outer casing is supplied as a heat source to a heat exchanger, for example, through the outlet port 46 formed in flange 42.

The cooling steam that has been supplied to cooling passage 41 cools outer tube 39 and inner tube 40 and then is supplied to other devices through an outlet port 53.

According to the embodiment of the present invention, steam bled from high pressure turbine 3 of steam turbine 1 is supplied as cooling steam to the intermediate pressure turbine 2. The supplied cooling steam is distributed to the space between turbine rotor 30 and inner casing 28, and to the space between inner casing 28 and outer casing 27. The cooling steam cools various constituent components, for example, nozzle box 45, turbine disk 37, gland portion 32 for inner casing 28, gland portion 31 for outer casing 27, reheated steam tube 35, inner casing 28, and outer casing 27, all of which may be exposed to the high temperature reheated steam. Since the constituent components are cooled in this manner, the strength of those constituent components are maintained even when the reheated steam reaching a temperature about 1300 or more degrees Fahrenheit is introduced to intermediate pressure turbine 2 of the steam turbine plant.

Other embodiments of the present invention will be apparent to those skilled in the art from consideration of the specification and practice of the invention disclosed herein. For example, the specific nature and form of cooling passages through the various constituent component may differ, such as to avoid any extensive modification of the components to include particular cooling paths therethrough. Further, the source of the cooling steam may come from any part of the plant that can provide relatively cooler steam, further preferably at a higher pressure than the reheated steam. Another alternative is not have particular cooling paths, such as the flow passage 41 associated with the reheated steam tube 35. Rather this tubing can be made of an alternative material designed to withstand the desired high temperature. This avoids the reheated steam from being cooled before flowing to the first stage of turbine. It is intended that the specification and example embodiments be considered as exemplary only, with a true scope and spirit of the invention being indicated by the following.

What is claimed is:

1. A steam turbine plant, comprising:

a steam generator that produces high pressure steam and reheated steam;

a high pressure turbine coupled with the steam generator and driven by the high pressure steam generated in the steam generator;

a steam bleed line coupled to the high pressure turbine, the steam bleed line bleeds steam from the high pressure turbine as cooling steam;

an intermediate pressure turbine coupled with the steam generator and driven by the reheated steam, the intermediate pressure turbine comprising:

a reheated steam inlet, comprising a nozzle box, for receiving the reheated steam, and a cooling steam inlet coupled with the steam bleed line to receive the cooling steam, the cooling steam being lower in temperature than the reheated steam at the reheated steam inlet;

a low pressure turbine driven by steam discharged from the intermediate pressure turbine;

a condenser that condenses the steam discharged from the low pressure turbine into a condensate; and a plurality of feedwater heaters which heat the condensate to form feedwater that is provided to the steam generator.

2. A steam turbine plant according to claim 1, wherein the intermediate pressure turbine includes a plurality of turbine stages, and wherein the cooling steam passes through the first of the plurality of turbine stages to cool at least a portion of the first turbine stage.

3. A steam turbine plant according to claim 1, wherein the cooling steam is at least 200 degrees cooler than the reheated steam.

4. A steam turbine plant according to claim 1, further comprising a desuperheater coupled to a last stage of the feedwater heaters.

5. A steam turbine, comprising:

a casing;

a rotor rotatably installed in the casing;

a plurality of turbine stages disposed in the turbine, at least one of the turbine stages including a turbine nozzle and including a moving blade that is fixed to the rotor;

a steam pass including the at least one turbine stage;

a reheated steam inlet, comprising a nozzle box, wherein the reheated steam inlet is coupled with the steam pass, for providing a reheated steam into the turbine; and a cooling steam inlet that introduces cooling steam to a space between the rotor and the casing, wherein a pressure of the cooling steam is greater than a pressure of the reheated steam.

6. A steam turbine according to claim 5, further comprising:

a steam supply tube communicatively coupled to the reheated steam inlet, the steam supply tube including an inner tube and an outer tube;

wherein the inner tube and the outer tube are coaxially disposed, forming a coaxial space therebetween, and wherein the cooling steam flows in the coaxial space between the inner tube and the outer tube.

7. A steam turbine according to claim 6, wherein the casing includes an outer casing and an inner casing, and wherein the cooling steam from the cooling steam inlet is introduced to a first space between the rotor and the inner casing, and is introduced to a second space between the inner casing and outer casing.

8. A steam turbine according to claim 6, further comprising:

a seal provided between the steam supply tube and the casing, wherein the seal reduces an amount of the cooling steam passing between the steam supply tube and the casing.

9. A steam turbine according to claim 8, wherein the seal comprises a plurality of rings disposed around the steam supply tube, the rings being of at least two different diameters, wherein the seal reduces an amount of the cooling steam passing between the steam supply tube and the casing.

10. A steam turbine according to claim 7, further comprising:

a first seal provided between the inner tube and the inner casing, wherein the first seal reduces an amount of the cooling steam passing between the inner tube and the inner casing; and a second seal provided between the outer tube and the outer casing, wherein the second seal reduces an amount of the cooling steam passing between the outer tube and the outer casing.

11. A steam turbine according to claim 10, further comprising:

an outlet provided between the outer tube and outer casing, wherein the cooling steam passing the second seal passes to the outlet.

12. A steam turbine according to claim 7, further comprising:

an outer diaphragm and an inner diaphragm to hold the turbine nozzle, the outer diaphragm being fixed to the inner casing;

wherein the cooling steam from the cooling steam inlet flows in a gap between the outer diaphragm and the inner casing.

13. A steam turbine according to claim 12, wherein the inner casing comprises an outlet configured to pass the cooling steam passing through the gap between the outer diaphragm and inner casing, the outlet passing steam to the second space between the outer casing and the inner casing.

14. A steam turbine according to claim 5, wherein the at least one turbine stage is the turbine stage positioned closest to the reheated steam inlet, and wherein the cooling steam introduced by the cooling steam inlet leads to the at least one turbine stage, and cools the turbine nozzle and the moving blade.

15. A steam turbine according to claim 14, wherein the at least one turbine stage is positioned downstream of the reheated steam inlet, and wherein the cooling steam introduced by the cooling steam inlet flows in at least part of an area between the rotor and the casing upstream of the reheated steam inlet.

16. A steam turbine according to claim 14, wherein the cooling steam passes through only a predetermined subset of the plurality of the turbine stages.

17. A steam turbine according to claim 16, wherein the cooling steam passes through only two turbine stages that are positioned closest to the reheated steam inlet.

18. A steam turbine according to claim 15, wherein the casing includes an outer casing and an inner casing, the inner casing being rotatably coupled to the rotor at a first coupling portion, and the outer casing being rotatably coupled to the rotor at a second coupling portion, and wherein the cooling steam introduced by the steam inlet passes through the first and second coupling portions.

19. A steam turbine according to claim 14, the rotor comprising a turbine disk portion, the moving blade of the at least one turbine stage being fixed to the turbine disk portion, and a passage formed through the turbine disk portion, the passage configured to flow cooling steam therethrough.

20. A method of operating a turbine in a steam turbine plant, the steam turbine plant having a high pressure turbine, an intermediate pressure turbine, and a low pressure turbine, the intermediate pressure turbine having a casing, a rotor rotatably disposed in the casing, a plurality of turbine stages positioned in the casing, a reheated steam inlet, comprising a nozzle box, and an auxiliary inlet, the method comprising the steps of:

introducing a reheated steam, which is reheated after discharge from the high pressure turbine, into the intermediate pressure turbine through the reheated steam inlet;

passing the reheated steam through the plurality of the turbine stages;

bleeding steam from the high pressure turbine as cooling steam;

introducing the cooling steam into the intermediate pressure turbine through the auxiliary inlet; and passing the cooling steam through at least one of the plurality of turbine stages, separated from the reheated steam, to cool at least a portion of the at least one turbine stages, wherein the cooling steam is significantly cooler than the reheated steam as introduced through the heated steam inlet.

21. A method according to claim 20, further comprising the step of passing the cooling steam along an outer surface of the reheated steam inlet.

22. A steam turbine plant, comprising:

a steam generator that produces high pressure steam and reheated steam;

a high pressure turbine coupled with the steam generator and driven by the high pressure steam generated in the steam generator;

a steam bleed line coupled to the high pressure turbine, the steam bleed line bleeds steam from the high pressure turbine as cooling steam;

an intermediate pressure turbine coupled with the steam generator and driven by the reheated steam, the intermediate pressure turbine comprising:

a reheated steam inlet, comprising a nozzle box, for receiving the reheated steam, and a cooling steam inlet coupled with the steam bleed line to receive the cooling steam, the cooling steam being lower in temperature than the reheated steam at the reheated steam inlet; and a low pressure turbine driven by steam discharged from the intermediate pressure turbine.

* * * * *